United States Patent [19]

Main

[11] Patent Number: 4,807,500

[45] Date of Patent: Feb. 28, 1989

[54] REVERSING RATCHET MECHANISM FOR TOOLS

[76] Inventor: Harvey M. Main, P.O. Box 376, South Fork, Colo. 81154

[21] Appl. No.: 930,771

[22] Filed: Nov. 14, 1986

[51] Int. Cl.[4] ..... B25B 13/46

[52] U.S. Cl. ..... 81/63.1; 81/60

[58] Field of Search ..... 81/60, 63.1, 63.2; 192/43.2, 46, 47, 45.1, 45.2; 74/578

[56] References Cited

U.S. PATENT DOCUMENTS

| | | | |
|---|---|---|---|
| 3,044,591 | 7/1962 | Kilness | 81/63.2 |
| 3,233,481 | 2/1966 | Bacon | 81/63 |
| 3,290,969 | 12/1966 | Bergquist et al. | 81/63.1 |
| 3,467,231 | 9/1969 | Haznar | 192/43.1 |
| 4,053,037 | 10/1977 | Solomon | 81/63 |
| 4,147,076 | 4/1979 | Wright et al. | 192/43.1 |
| 4,406,186 | 9/1983 | Gummow | 81/60 |
| 4,520,697 | 4/1985 | Moetteli | 192/43.1 |

*Primary Examiner*—Frederick R. Schmidt
*Assistant Examiner*—Robert Showalter
*Attorney, Agent, or Firm*—Timothy J. Martin; J. Preston Oxenham

[57] ABSTRACT

A ratchet drive tool includes ratchet head that has a cylindrical aperture and a drive member rotatably mounted in the aperture. The drive member has a drive shaft that projects axially outwardly of the aperture and a pawl support structure oppositely positioned from the drive shaft. The pawl support structure has a flat slide surface oriented in a slide plane parallel to the rotational axis of the drive member. A pawl member has flat surface portions constrained for sliding movement along the slide surface between left and right drive positions wherein left and right ratchet teeth on the pawl member respectively engage longitudinal ratchet teeth on the inner surface of the aperture. The pawl member is radially biased into the selected drive position in relation to the rotational axis by a spring and pin member, and a switch operates to move the pawl member between the left and right drive positions. In an alternate form, two pawl members respectively slide on parallel slide surfaces.

25 Claims, 3 Drawing Sheets

REVERSING RATCHET MECHANISM FOR TOOLS

BACKGROUND OF THE INVENTION

The present invention is directed to ratchet mechanisms of the type often used in ratcheting tools such as ratchet wrenches, ratchet screwdrivers, speed wrenches, and the like. This invention is specifically directed to a reversing ratchet mechanism which has both a simplified construction and increased mechanical strength. Thus, while the present invention is described as it directly relates to ratchet wrenches, it should be appreciated that the scope of the present invention encompasses the general field of ratcheting devices.

Ratcheting devices have been extensively developed in the past; however, the trend of such development has been to produce increasingly complicated ratchet mechanisms requiring a multiplicity of elements. While these complicated structures have accomplished the goal of functionality the increased complexity of the mechanisms has led to disadvantages. For example, as in any product, the increased complexity of the structure correspondingly increases production costs. These increased production costs result both from the cost of producing the specialized parts which make up the structure and in the increase of labor costs in assembling the device. Another disadvantage with complicated mechanisms is the risk of failure, especially where failure of a single element may result in failure of the device as a whole. Thus, with the increased number of parts, it raises the likelihood of a part failure that may result in major failure of the device. Finally, due to the size and complexity of parts, complicated ratcheting structures are more susceptible to contamination by dirt or other substances which can cause the mechanisms to jam or otherwise fail to perform.

The ratcheting structure according to the present invention is developed to simplify the construction of ratchet drives so that only a minimal number of parts are used in constructing the device. Since these parts are packaged in a standard sized wrench, each part can take on larger dimensions so as to increase the mechanical strength of the mechanism making the ratchet drive more durable and resistive to shear forces than the smaller parts of more complex mechanisms. The present invention accomplishes this greater strength by providing a sliding pawl member which slides across a slide surface. This pawl member is placed under compression forces against the slide surface. Prior art ratchet structures typically utilize relatively small pawl members or "dogs" which pivot between left and right drive positions on a pivot pin.

One example of such a pivot pawl structure is found in U.S. Pat. No. 4,147,076 issued Apr. 3, 1979 to Wright, et al. Likewise, U.S. Pat. No. 3,233,481 issued Feb. 8, 1966 to Bacon and U.S. Pat. No. 4,406,186 issued Sept. 27, 1983 to Gummow disclose ratchet mechanisms wherein the ratchet controlling pawl element is pivotally mounted on a pivot pin. Numerous other pivoting pawl structures are known in the prior art. The problem with these pivoting pawl structures, as noted above, is that the torque forces placed on the drive mechanism may cause a shearing of a pawl pivot pin or breakage of the pawl member thus causing a breakdown of the ratchet structure.

U.S. Pat. No. 3,044,591 issued July 17, 1962 to Kilness and U.S. Pat. No. 4,053,037 issued Oct. 11, 1977 to Solomon each disclose different structures wherein the pawl element pivots between left and right drive positions but is not constrained for pivotal motion about a pivot pin. Rather, the pawl member in these two patents floats on biasing elements which allow pivotal movement. U.S. Pat. No. 4,520,697 issued June 4, 1985 to Moetelli discloses a fairly complicated ratchet structure wherein a small ratcheting element slides along an arcuate surface portion of a drive member and is held in position by means of a biasing spring or pin which moves along with and controls movement of the pawl element. Due to its construction, this pawl element is of extremely small size so that only a small surface region of pawl element becomes engaged in the drive mode.

SUMMARY OF THE INVENTION

It is an object of the present invention to provide a novel ratcheting mechanism which is useful in the construction of ratcheting devices such as wrenches, tools and the like and which ratcheting mechanism is simplified in construction for ease in manufacture.

It is a further object of the present invention to provide a ratchet mechanism which is less complicated in manufacture and which has increased mechanical strength over traditional ratcheting mechanisms.

It is a still further object of the present invention to provide a ratcheting mechanism whihc substantially eliminates the shear forces and the ratcheting pawl so that the pawl is predominantly placed under compression forces for increased mechanical strength.

It is yet a further object of the present invention to provide a ratchet mechanism when a simplified structure is less susceptible to breakage and to degredation from dirt or other foreign substances.

Another object of the present invention is to provide a ratchet mechanism wherein the direction of drive for the ratcheting mechanism is controlled by a rotatable switch wherein the direction of rotation of the switch is identical to the resultant ratchet drive direction.

According to the present invention, then, a ratchet drive mechanism is provided which is specifically adapted for use in a ratchet drive tool that is operative to rotatably drive a work piece. In the broad form of the present invention, a ratchet head has a cylindrical aperture formed therethrough with the cylindrical aperture centered on a rotational axis. This aperture has an interior sidewall which is formed along a first radius of curvature and which is provided with first ratchet teeth. A drive member is mounted within the aperture and is rotatable about the rotational axis. The drive member includes a base from which a drive shaft extends axially from a first side thereof. The shaft projects exteriorally of the aperture in order to engage a work piece. A pawl support structure is located on a second side of the base opposite the drive shaft with the pawl support structure having a slide surface oriented in a slide plane parallel to the rotational axis. A pawl member is supported by the pawl support structure and has flat surface portions which slideably move along the slide surface. The pawl member also has an outer arcuate surface formed along a second radius of curvature which is less than the first radius of curvature. The arcuate surface of the pawl member is provided with second ratchet teeth which define left ratchet and right ratchet teeth. When the pawl member is slid along the slide surface, the left and right ratchet teeth respectively become engaged with the first ratchet teeth to define left and right drive directions. An upright post constrains the movement of the pawl member to maintain portions in sliding engaged relation with the slide surface. Pawl biasing elements bias the pawl member into the selected left or right drive position. A switch member is operative to switch the pawl biasing means between the left and right drive positions to define a positive drive direction wherein the drive member first becomes locked for common rotation with the ratchet head when the ratchet head is rotated in the positive drive direction yet which, due to the pawl biasing elements becomes relatively rotatable with respect to the tool head when the tool head is rotated in a ratchet direction opposite the positive drive direction.

In the embodiments of the present invention, it is desireable that the ratchet teeth be formed at right angles which are symmetrically located along equiangularly spaced radial planes containing the rotational axis. Accordingly, where left and right imaginary planes which include the rotational axis are oriented at 45° to the slide plane, the pawl member is configured so that a greater number of the left and right ratchet teeth, respectively, engage the first ratchet teeth on a side of the imaginary plane's that is closer to a ratchet plane that is perpendicular to the slide plane and includes the rotational axis. This structure prevents the pawl element from becoming disengaged during the ratcheting operation and places the pawl element into a mechanical compression.

Preferably, the switch member has a disc-shaped top and an axially projecting shank which is received within the pawl support structure, and the pawl biasing elements comprise a spring biased pin which extends radially outwardly from the shank to resiliently abut an arcuate portion of the pawl element between the two flat surface portions which slide along the slide surface. Thus, in one embodiment the pawl support structure is in the shape of a C-shaped block where the ends of the C-shaped block define the slide surface and where the opening in the C-shaped block receives the axial shank of the switch member. In an alternate embodiment, two identical pawl elements are provided and the pawl support structure is in the form of two diametric blocks defining a pair of slide surfaces for each respective pawl. The pawl biasing means then includes a pair of diametric pins outwardly and radially biased from the shank so that a respective pin biases and moves a respective pawl element between the left and right drive positions. The ratchet head may be conveniently supplied with a lever arm for increasing mechanical advantage in rotating the ratchet head to drive the work piece.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

Figure 1:
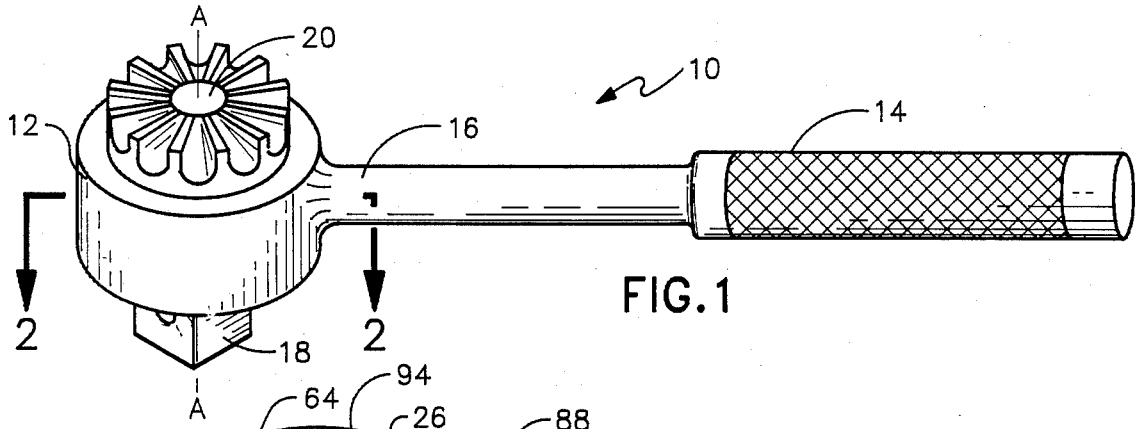
FIG. 1 is a perspective view of a ratchet wrench containing the ratchet drive mechanism according to the preferred embodiment of the present invention.

A novel and useful ratchet mechanism is provided by the present invention and is particularly adapted for use as a drive mechanism for a tool, such as a ratchet wrench. Accordingly, the present invention is described with respect to such a tool although it should be understood that the ratchet mechanism according to the present invention could be incorporated into other mechanical structures without departing from the inventive features of this invention. Accordingly, as is shown in FIG. 1, a ratchet drive tool or wrench 10 is shown having a ratchet head 12 which is provided by a handle 14 connected thereto by means of a shank 16. In normal ratchet wrenches, ratchet head 12, shank 16 and handle 14 are formed as an integral unit forged of tool steel. Ratchet head 12 supportably mounts a ratchet mechanism which is described more fully below, with this ratchet mechanism including a drive shaft 18 adapted to mount a work piece, such as a common socket driver. A switch element 20 is also mounted by ratchet head 12 and may be manipulated between first and second drive positions corresponding to a left ratchet drive and a right ratchet drive.

The ratchet structure according to the preferred embodiment of the present invention is best shown in FIGS. 2–5. As is shown in these figures, ratchet head 12 has a generally cylindrical aperture 22 formed therethrough and centered on rotational axis A. Aperture 22 has an internal surface 24 which is provided with a plurality of first ratchet teeth 26 preferably in the form of elongated ribs formed longitudinally of ratchet head 12 parallel to rotational axis A. Ribs or teeth 26 are each formed having perpendicular surfaces, such as surfaces 28 and 30 and are oriented so that each apex, such as apex 32, shown in FIG. 2, points radially toward axis A.

A drive member 34 is received within aperture 22, and includes a base 36 from which axially projects drive shaft 18. Drive shaft 18 has a radial bore 38 which mounts a spring 40 that outwardly biases a ball 42 operative to retain a work piece, in a manner known in the art. Accordingly, drive shaft 18 is rotatable about rotational axis A and projects outwardly of aperture 22. A pawl support structure is formed on base 36 opposite drive shaft 18.

Figure 2:
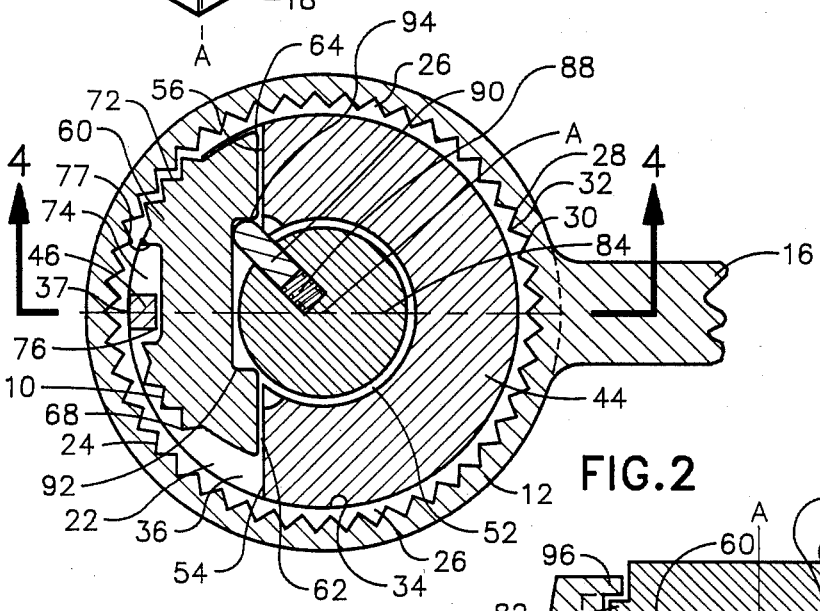
FIG. 2 is a cross-sectional view taken at line 2—2 of FIG. 1 with the pawl element in a right drive position.
Figure 3:
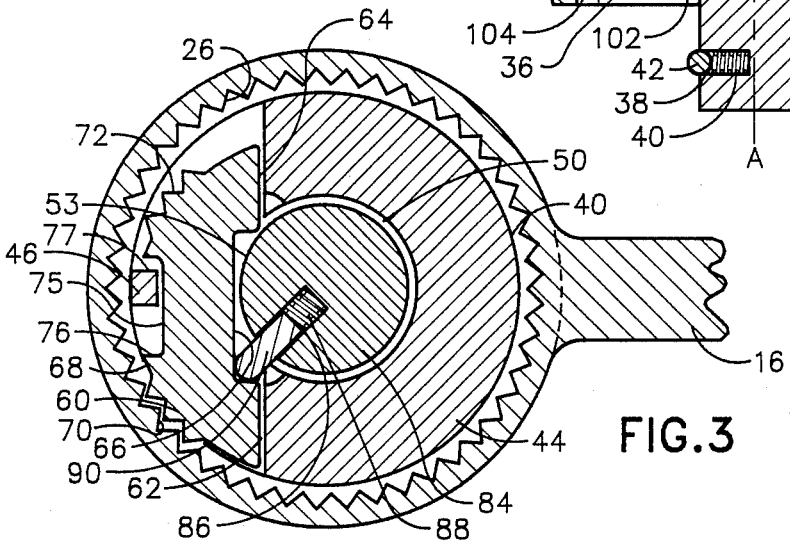
FIG. 3 is cross-sectional view similar to FIG. 2 but with the pawl element in a left drive position.
Figure 5:
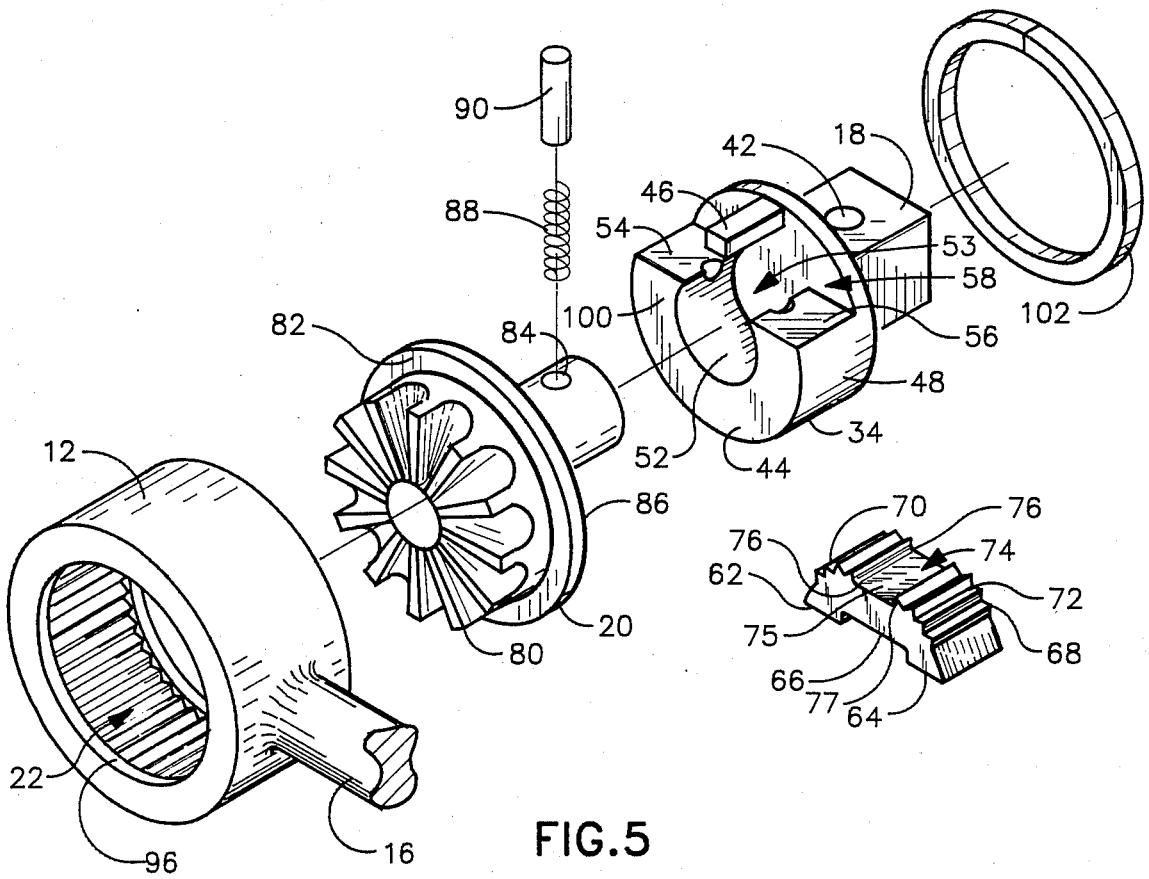
FIG. 5 is an exploded view in perspective of the ratchet drive mechanism shown in FIGS. 2–4.

In the preferred embodiment, as is best shown in FIGS. 2, 3 and 5, the pawl support structure includes a C-shaped block 44 and an upstanding post 46. C-shaped block 44 has an outer arcuate surface 48 and an inner arcuate surface 50 that describes a generally axial opening 52 centered on rotational axis A. C-Shaped block 44 has a pair of flat ends 54 and 56 which are oriented in a common slide plane S which is parallel to axis A and spaced therefrom. A side entryway 53 into opening 52 is thus formed between ends 54 and 56. Post 46 is located in a ratchet plane T which plane is perpendicular to slide plane S and contains rotational axis A. Thus, open region 58 is located between post 46 and flat ends 54 and 56 and provides a region to receive a ratchet pawl element 60, as described below. Post 46 is positioned longitudinally in spaced parallel relation to a slide surface along the peripheral edge 37 of base 36.

Pawl member 60 is preferably an arcuately shaped piece having first and second flat surface portions 62 and 64 which are separated by an inner arcuate cavity or area 66. Pawl member 60 has an outer arcuate surface 68 which has a smaller radius of curvature than surface 24 of aperture 22. Outer arcuate surface 68 is provided with first and second ratchet teeth 70 and 72 separated from one another by a longitudinal channel 74 in order to form left and right ratchet teeth, respectively. Channel 74 has a bottom 75 and opposite sides 76 and 77.

Pawl member 60 is mounted in open region 58, as is best shown in FIGS. 2 and 3. As is shown in FIGS. 2 and 3, pawl element 60 is sized so that flat surface portions 62 and 64 are in sliding and abutting relation respectively with flat ends 54 and 56. When positioned in region 58, post 46 is received within channel 74 so that post 46 bears against bottom 75. Accordingly, post 46 constrains pawl member 60 for movement along the slide surface formed by flat ends 54 and 56 in slide plane S. Further, as is shown in FIGS. 2 and 3, pawl member 60 may slide between a right drive position, shown in FIG. 2, wherein right ratchet teeth 72 engage the first ratchet teeth 26 and a left drive position, shown in FIG. 3, wherein left ratchet teeth 68 engage first ratchet teeth 26. In the right drive position, post 46 abuts side 76 of channel 14, and, in the left drive position, post 46 abuts side 77 of channel 74.

In order to move pawl element 60 between the left and right drive positions, as well as to bias pawl member 60 for ratcheting engagement with the first ratchet teeth 26, switch element 20 includes an interior positioning and biasing structure as well as exterior structure adapted to permit manual switching of pawl element 60. Specifically, as is shown in FIGS. 2–5, switch member 20 has a head 80 provided with a radially outwardly projecting shoulder 82 and an axially projecting shank 84. Shank 84 is provided with a radial bore 86 which mounts a spring 88 and a ratchet pin 90 so that ratchet pin 90 is radially outwardly biased from shank 84. Shank 84 is cylindrical in shape and is sized for close fitted insertion into opening 52, so that as head 80 is rotated, shank 84 will be correspondingly rotated within C-shaped block 44 with pin 90 extending through entryway 53. Pin 90 will thus be moved between a right drive position, shown in FIG. 2, wherein pin 90 is adjacent flat end 56 and a left drive position, shown in FIG. 3, wherein pin 90 is adjacent flat surface 54. When assembled, as is shown in FIGS. 2 and 3, pin 90 is biased against inner arcuate area 66 and will move between side quarter cylindrical surfaces 92 and 94 thereof. When pin 90 is positioned against side cylindrical surface 94, pawl member 60 is moved into the right drive position and biased such by spring 88 so that right ratchet teeth 72 engage first ratchet teeth 26. Similarly, when shank 84 is rotated so that pin 90 is moved across arcuate area 66 to abut cylindrical side surface 92, pawl member 60 is moved out of the right drive position and into the left drive position shown in FIG. 3. Spring 88 maintains the bias of pawl member 60 so that left ratchet teeth 70 are engaged with first ratchet teeth 26 in the left drive position, shown in FIG. 3. Cavities 55 and 57 are respectively provided along inner edges of flat surfaces 54 and 56 to accommodate the nose of pin 90. Other biasing means such as a ball and spring assembly, leaf springs and the like could be used to bias pawl member 60.

Figure 4:
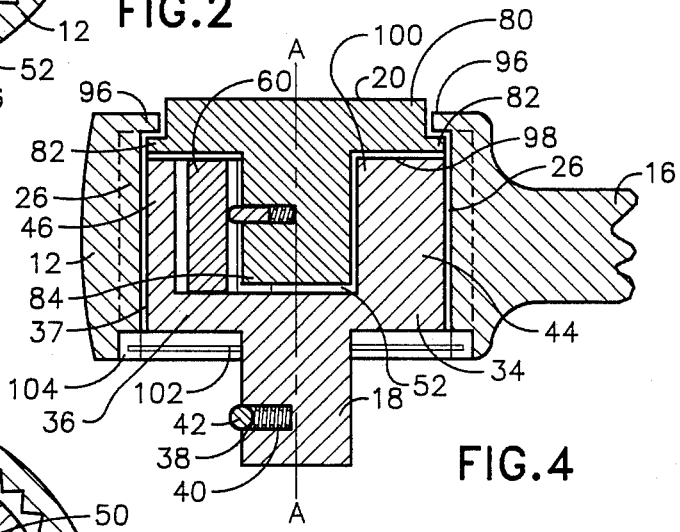
FIG. 4 is a cross-sectional view taken about lines 4—4 of FIG. 2.

The assembly of this ratchet drive mechanism according to the preferred embodiment of the present invention may now be best appreciated with reference to FIGS. 4 and 5. As is shown in these figures, pawl member 60 is first inserted into opening 58 so that post 46 is received in channel 74 with flat surface portions 62 and 64 respectively abutting flat ends 54 and 56. Spring 88 and pin 90 are inserted into bore 86 in shank 84, and shank 84 is inserted into opening 52 so that surface 98 of head 80 abuts upper surface 100 of C-shaped block 44. In this position, pin 90 is biased against and abuts area 66 of pawl member 60. The assembled unit of drive member 34 and head 20 is then inserted into aperture 22 so that shoulder 82 of head 20 abuts a radially inwardly projecting lip 96 formed on one end of ratchet head 12 to enclose one side of aperture 22. This assembly is then retained in ratchet head 12 by means of a spring clip 102 received in groove 104 which extends around the inner surface 24 of ratchet head 12 and a side thereof opposite lip 96, as is known in the art. Base 36 thus encloses the other side of aperture 22.

Figure 6:
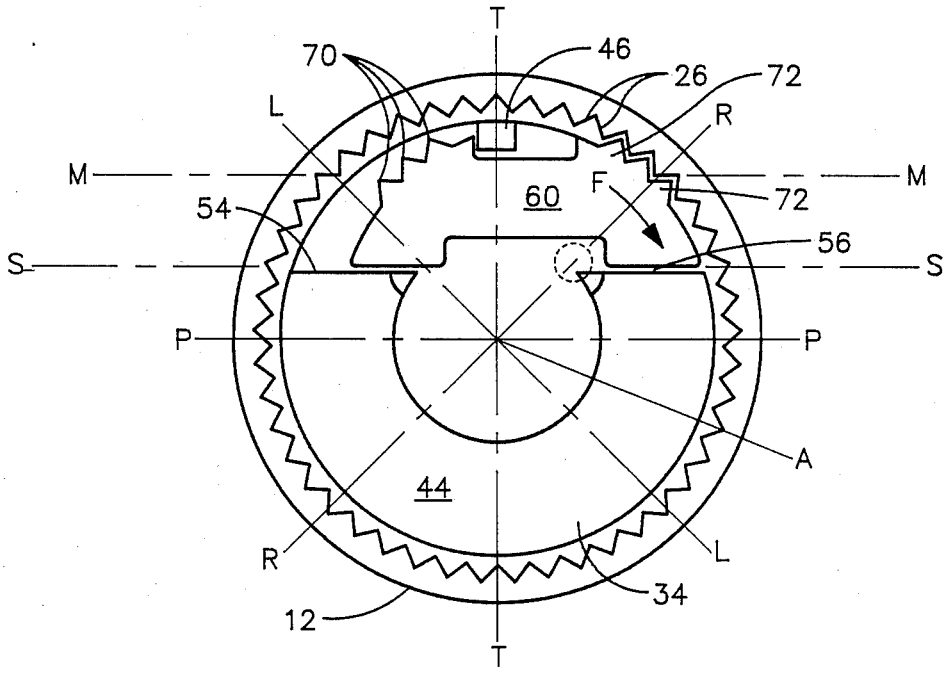
FIG. 6 is a top plan view of the drive member and pawl support structure according to the preferred embodiment of the present invention shown mounted in the ratchet head.

The relationship of the left and right ratchet teeth and the first ratchet teeth to the positioning of flat ends 54 and 56 is best shown in FIG. 6. In order to best understand FIG. 6, it should be appreciated that slide plane S is the plane containing flat ends 54 and 56 and axis plane P is that plane parallel to slide plane S which contains rotational axis A. Imaginary ratchet plane T is thus defined to be the plane containing rotational axis A and perpendicular to both slide plane S and axis plane P. An imaginary left plane L contains axis A and bisects axis plane P and ratchet plane T, and an imaginary right plane R contains axis A and bisects ratchet plane T and axis plane P. Accordingly, planes L and R are perpendicular to one another with plane L being located on a left drive side of ratchet head 12 and with plane R being on a right drive side of ratchet head 12. When pawl member 60 is in the right drive position, as is shown in FIG. 6, it may be seen that two of right drive teeth 72 engage first drive teeth 26 at a location between planes R and T. Only one right drive tooth 72 engages teeth 26 in that region between planes R and P. Correspondingly, in the left drive position, two ratchet teeth 70 would engage teeth 26 in the region between planes L and T while only one left ratchet tooth 70 would engage teeth 26 between planes L and P. Accordingly, the ratchet relationship will be described with respect to the right drive position shown in FIG. 6.

As may be appreciated from a review of FIG. 6, when right drive teeth 72 are engaged, a rotational movement of ratchet head 12 in a clockwise direction will cause drive teeth 26 to jam against teeth 72 thereby locking pawl member 60 against flat end 56. As clockwise movement is continued, this force tends to compress pawl member 60 in the force direction F and thus causes drive member 34 to be rotated in a clockwise direction. Further, since the two engaged teeth 72 between planes T and R have surfaces 30 that are oriented at an angle with respect to plane P, surfaces 30 tend to force pawl member 60 to the right therefore maintaining the engaged drive position. The plane of the engaged face of tooth 72 between planes R and P is parallel to plane P, as is shown by line M, so that this engaged tooth has no effect on the left or right movement of pawl member 60. However, it would be undesirable to have additional engaged teeth between planes R and P since the right angle configuration of the teeth would cause such additional engaged teeth to tend to force pawl member 60 to the left. Thus, any additional tooth engaged between planes R and P would tend to disengage pawl member 60 during the positive ratchet drive corresponding to a clockwise rotation of ratchet head 12.

Accordingly, it should be appreciated that slide plane S is oriented at an off axis position and located such that, for a selected pawl member 60 there is always a greater number of engaged right ratchet teeth between planes R and T than there are between planes R and P. Similarly, for left ratchet teeth 70, there should always be a greater number of engaged left teeth between planes L and T then between planes L and P. Such configuration always tends to maintain the positive engagement of pawl member 60 with drive teeth 26 during a positive drive angular direction. However, when the ratchet head is rotated in an angular ratchet direction opposite the positive drive direction, surfaces 28 will cause the engaged teeth to drive past first ratchet teeth 26 under the bias of spring 88 and ratchet pin 90. Further, it should be appreciated from the foregoing, that switching element 20 is rotated clockwise to move pawl member 60 into the right drive position (for positive clockwise drive) and is rotated counterclockwise to move pawl member 60 into the left drive position (for positive counterclockwise drive). Thus, the rotational movement of switching element 20 is identical to the positive drive direction. Naturally, the definition of left and right drive teeth, as well as left and right drive directions are selected as a matter of convenience in explaining the invention and could readily be interchanged with one another.

Figure 7:
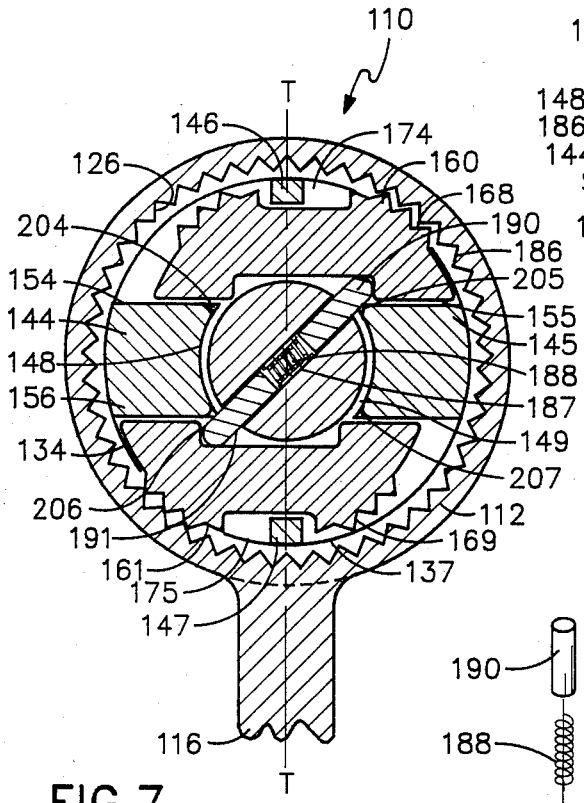
FIG. 7 is a top view in cross section of an alternate embodiment of the present invention in a right drive position.
Figure 8:
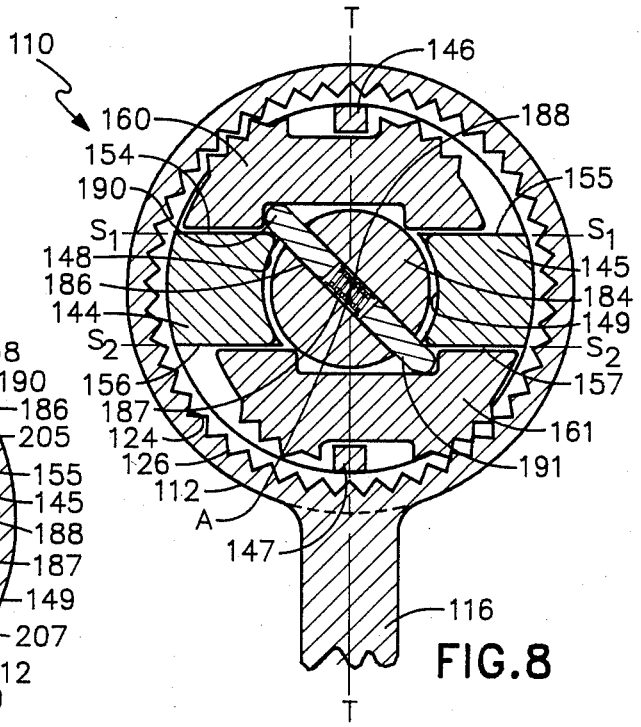
FIG. 8 is a top view in cross section of the embodiment shown in FIG. 7 but with the two pawl elements in a left drive position.
Figure 9:
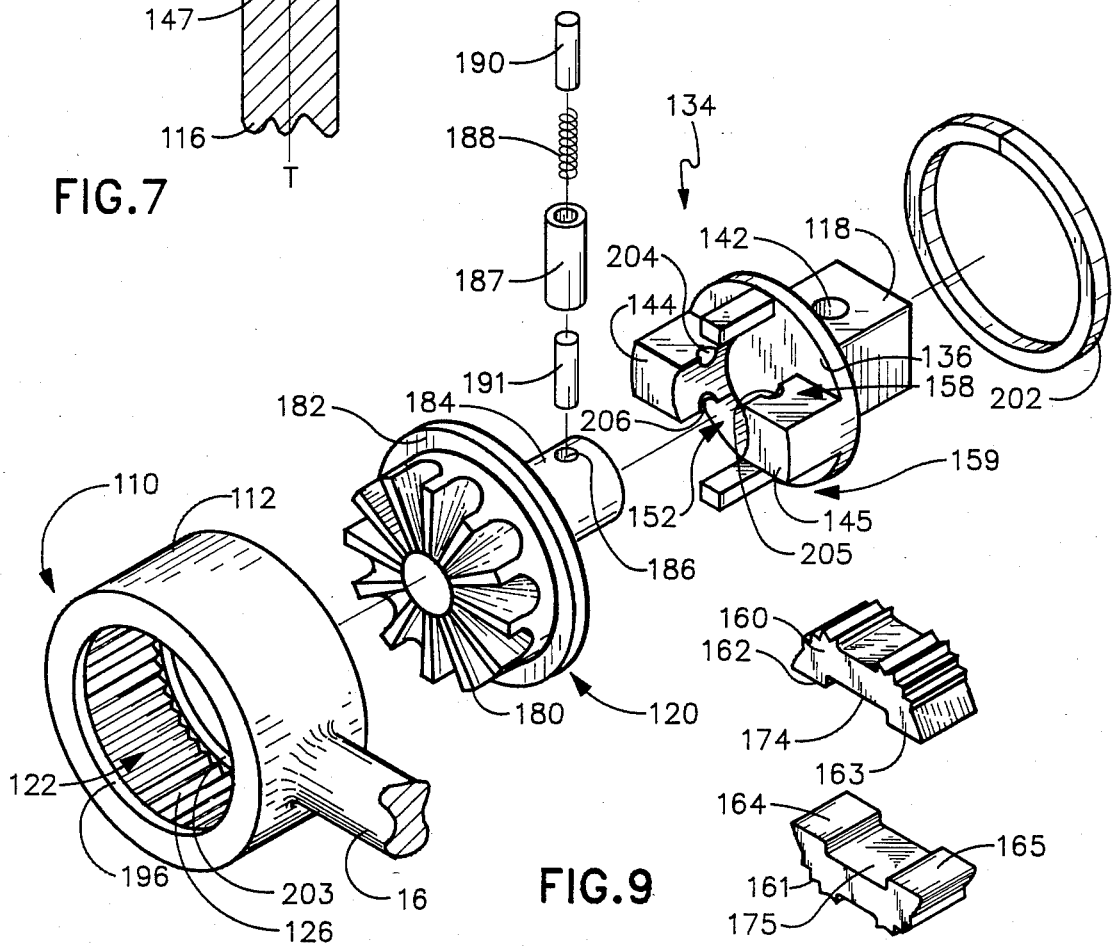
FIG. 9 is an exploded view in perspective of the alternate embodiment of the present invention shown in FIGS. 7 and 8.

An alternate embodiment of the present invention is shown in FIGS. 7–9, and it should be appreciated that this alternate embodiment utilizes a pair of pawl members 160 and 161 which are switchable between left and right drive positions. As is shown in these figures, wrench 110 has a ratchet head 112 connected to a handle (not shown) by means of a shank 116. Ratchet head 112 has an aperture 122 formed therein, with aperture 122 having inner surface 124 provided with first ratchet teeth 126, similar to aperture 22 of ratchet head 12, described above. Aperture 112 receives a switch element 120 that has a switch head 180 and a surrounding shoulder 182 which abuts a lip 196 formed on one side of ratchet head 122. Switch element 122 includes a shank 184 which has a diametric bore 186 extending completely therethrough with diametric bore receiving a spring 188 and a pair of ratchet pins 190 and 191. To this end, spring 188 and pins 190 and 191 are received within a sleeve 187 that is mounted in diametric bore 186.

A drive member 134 has a base 136 which supports, on one side thereof, an axially extending drive shaft 118 on one side thereof. Drive shaft 118 receives a spring biased ball 142 and is adapted to permit attachment of a work piece, such as a socket, to drive member 134. A pawl support structure is mounted on a side of base 136 opposite drive shaft 118 and includes a pair of diametrically positioned, upright blocks 144 and 145 which have facing cylindrical surface portions 148 and 149, respectively. Surface portions 148 and 149 face each other to define an opening 152 which is sized to telescopically receive shank 184 of switch element 120. Block 144 has a pair of parallel, flat surfaces 154 and 156 which are spaced apart form one another, and block 145 has a pair of parallel, flat surfaces 155 and 157, also spaced apart from one another. Flat surfaces 154 and 155 lie in a common plane and define a first slide surface $S_1$ and surfaces 156 and 157 lie in a common plane and define a second slide plane $S_2$. Planes $S_1$ and $S_2$ are parallel to one another and lie on either side of rotational axis A. The pawl support structure also includes two diametric posts, 146 and 147 located around peripheral edge 137 of base 136. Posts 146 and 147 lie along a ratchet plane T which is perpendicular to planes $S_1$ and $S_2$.

A first pawl member 160, and a second pawl element 161 are mounted in open regions 158 and 159, respectively. Pawl member 160 has flat surface portions 162 and 163 which slideably engage flat surfaces 154 and 155 of blocks 144 and 145, respectively. Pawl member 160 is held in position by means of post 146 which is received in a channel 174 formed in an outer arcuate surface 168 of pawl member 160. Thus, post 146 constrains pawl member 160 for sliding movement along surfaces 154 and 155 in plane $S_1$. Similarly, pawl member 161 has a pair of flat surface portions 164 and 165 which slideably engage flat surfaces 156 and 157 of blocks 144 and 145, respectively. Post 147 is received in a channel 175 formed on an outer arcuate surface 169 of pawl 161. Thus, post 147 constrains pawl 161 for sliding movement along surfaces 156 and 157 in plane $S_2$.

When assembled, shank 184 of switch element 120 is positioned in opening 152 and is rotatable therein. Ratchet pins 190 and 191 respectively engage inner arcuate areas 166 and 167 of pawl members 160 and 161 and are operative, upon rotation of shank 184, to move pawl members 160 and 161 from a right drive position shown in FIG. 7 to a left drive position shown in FIG. 8. To help accommodate ratchet pin 190 as it is moved between these two positions, a cavity 204 is formed on an edge of block 144 and a cavity 205 is formed on an edge of block 145. Similarly, to accommodate ratchet pin 191, a cavity 206 is formed on the other edge of block 144 and a cavity 207 is formed on the other edge of block 145. The entire assembly is then retained in aperture 122 by means of spring clip 202 received in groove 203 in ratchet head 112.

It should be appreciated from the foregoing that the structure according to the preferred embodiment shown in FIGS. 7–9 provides a pair of pawl elements each of which are switchable between left and right drive positions rotatably symmetric with each other about axis A. Each of pawl elements 160 and 161 engage first ratchet teeth 126 in the manner described with respect to the preferred embodiment with each of slide planes $S_1$ and $S_2$ being located rotationally symmetric with slide plane S described with respect to the preferred embodiment. Accordingly, the drive member of the alternate embodiment is formed by removing a portion of the C-shaped block so that a pair of slide surfaces are formed in parallel spaced relation. This structure naturally doubles the amount of engaged ratchet teeth so that a substantial surface area is engaged during a positive drive motion.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A ratchet drive tool adapted to rotatably drive a work piece, comprising:

a ratchet head having a cylindrical aperture formed therethrough and centered on a rotational axis, said aperture having an interior sidewall which has a first radius of curvature and which is provided with first ratchet teeth therearound;

a drive member mounted within said aperture and rotatable about said rotational axis, said drive member including a base portion, a drive shaft extending axially from a first side of said base portion exteriorly of said aperture in order to engage said work piece, and a pawl support structure on a second side of said base portion opposite said drive shaft, said pawl support structure having a planar slide surface oriented in a slide plane parallel to the rotational axis;

a pawl member supported by said pawl support structure movable with respect thereto, said pawl member having flat surface portions and an outer arcuate surface which has a second radius of curvature less than said first radius of curvature, said arcuate surface provided with second ratchet teeth defining left ratchet teeth and right ratchet teeth;

constraining means for constraining the movement of said pawl member such that said flat surface portions sideably engage said slide surface for movement therealong;

pawl biasing means switchable between a left drive position for resiliently biasing said left ratchet teeth into engagement with said first ratchet teeth on one side of an imaginary ratchet plane perpendicular to said slide plane and containing said rotational axis and a right drive position for resiliently biasing said right ratchet teeth into engagement with said first ratchet teeth on the other side of said ratchet plane such that selected engagement of said left and right ratchet teeth with said first ratchet teeth defines a selected positive drive direction whereby said drive member becomes locked for common rotation with said ratchet head when said ratchet head is rotated in the positive drive direction yet which permits relative ratchet rotation of said ratchet head with respect to said drive member when said ratchet head is rotated in a direction opposite the positive drive direction; and a switch member mountably receiving said pawl biasing means operative to switchably move said pawl biasing means between said left and right drive positions, said interior sidewall, pawl member and constraining means arranged such that there is an imaginary axis plane parallel to said slide plane and including said rotational axis and imaginary left and right planes which are perpendicular to one another and which bisect left and right regions, respectively, between said ratchet plane and said axis plane, said slide plane being spaced from said axis plane and wherein said left ratchet teeth will engage said first ratchet teeth in said left region, there being a greater number of engaged left teeth on a side of said left plane closer to said ratchet plane, and wherein said right ratchet teeth will engage said first ratchet teeth in said right region, there being a greater number of engaged right teeth on a side of said right plane closer to said ratchet plane.

2. A ratchet tool according to claim 1 wherein each of said first ratchet teeth are defined by right angle ribs symmetric about respective radially extending planes containing said rotational axis.

3. A ratchet drive tool adapted to rotatably drive a work piece, comprising:

a ratchet head having a cylindrical aperture formed therethrough and centered on a rotational axis, said aperture having an interior sidewall which has a first radius of curvature and which is provided with first ratchet teeth therearound;

a drive member mounted within said aperture and rotatable about said rotational axis, said drive member including a base portion, a drive shaft extending axially from a first side of said base portion exteriorly of said aperture in order to engage said work piece, and a pawl support structure on a second side of said base portion opposite said drive shaft, said pawl support structure having a slide surface oriented in a slide plane parallel to the rotational axis;

a pawl member supported by said pawl support structure movable with respect thereto, said pawl member having flat surface portions and an outer arcuate surface which has a second radius of curvature less that said first radius of curvature, said arcuate surface provided with second ratchet teeth defining left ratchet teeth and right ratchet teeth;

constraining means for constraining the movement of said pawl member such that said flat surface portions sideably engage said slide surface for movement therealong said constraining means including a post element forming a portion of said pawl support structure, said post element positioned longitudinally in spaced parallel relation to said slide surface, and a channel longitudinally formed in the arcuate surface of said pawl member, said channel having spaced sides and a bottom, said post element received in said channel and bearing against said bottom to hold said flat surface portions against said slide surface, said sides spaced a sufficient distance apart and said post element dimensioned whereby said pawl member may be slideably moved between said left and right drive positions;

pawl biasing means switchable between a left drive position for resiliently biasing said left ratchet teeth into engagement with said first ratchet teeth on one side of an imaginary ratchet plane perpendicular to said slide plane and containing said rotational axis and a right drive position for resiliently biasing said right ratchet teeth into engagement with said first ratchet teeth on the other side of said ratchet plane such that selected engagement of said left and right ratchet teeth with said first ratchet teeth defines a selected positive drive direction whereby said drive member becomes locked for common rotation with said ratchet head when said ratchet head is rotated in the positive drive direction yet which permits relative ratchet rotation of said ratchet head with respect to said drive member when said ratchet head is rotated in a direction opposite the positive drive direction; and a switch member operative to switch said pawl biasing means between said left and right drive positions.

4. A ratchet tool according to claim 1 wherein said pawl biasing means includes a radially extending pin that is spring biased against said pawl member.

5. A ratchet tool according to claim 4 wherein said switch member includes an axial shank, aligned with said rotational axis, said pin being received within a radial bore formed in said shank and a spring received in said bore to outwardly bias said pin.

6. A ratchet tool according to claim 1 wherein said base portion is defined by a disc-shaped plate, said pawl support structure includes a C-shaped block rigidly connected to said plate, the ends of said C-shaped block lying in a common plane and defining the slide surface, said switch member including an axial shank rotatably received within an opening in said C-shaped block.

7. A ratchet tool according to claim 6 wherein said shank having a radial bore, said pawl biasing means including a spring in said bore and a pin biased against said spring and projecting outwardly of said shank to radially bear against said pawl member.

8. A ratchet tool according to claim 7 wherein said pawl member has a concavity separating a side surface thereof opposite said arcuate surface into a pair of flat surface portions, said pin extending within the concavity to contact said pawl member.

9. A ratchet tool according to claim 1 wherein said pawl support structure having two parallel slide surfaces, one on either side of said rotational axis, and a pair of pawl members, each said pawl member having flat surface portions slideably engaging a respective slide surface and contrained for movement therealong and having left and right ratchet teeth on an arcuate surface opposite said flat surface portions, the left ratchet teeth of each pawl member engaging the first ratchet teeth in the left drive position and the right ratchet teeth of each pawl member engaging the first ratchet teeth in the right drive direction.

10. A ratchet tool according to claim 9 wherein said switch member includes an axial shank extending along the rotational axis and positioned within said pawl support structure, said shank having a diametric bore formed therethrough, said pawl biasing means including spring mounted in said bore and a pair of pins each extending radially outwardly of said shank on opposite ends of said bore and resiliently bearing against a respective pawl element.

11. A ratchet tool according to claim 1 including an elongated handle means rigidly connected to said tool head for rotating said tool head about the rotational axis with mechanical advantage.

12. A ratchet drive tool adapted to rotatably drive a work piece, comprising:

a ratchet head having a cylindrical aperture formed therethrough and centered on a rotational axis, said aperture having an interior sidewall which has a first radius of curvature and which is provided with first ratchet teeth therearound;

a drive member mounted within said aperture and rotatable about said rotational axis, said drive member including a disc-shaped base having a surrounding circular edge dimensioned for close-fitted mounting at one end of said aperture, a drive shaft extending axially from a first side of said base exteriorly of said aperture and adapted to engage a work piece whereby rotation of said base rotatably drives said drive shaft, and a pawl support structure on a second side of said base opposite said drive shaft, said pawl support structure including a C-shaped block rigidly secured to said base and centered on said rotational axis, said block extending into said aperture and having first and second flat end surfaces defining a slide surface oriented in a slide plane parallel to and spaced from said rotational axis, said block having a semi-cylindrical opening centered on said rotational axis and having an entryway between said flat end surfaces;

a pawl member supported by said pawl support structure moveable with respect thereto, said pawl member having first and second flat surface portions and an outer arcuate surface which has a second radius of curvature less than said first radius of curvature, said arcuate surface provided with second ratchet teeth defining left ratchet teeth and right ratchet teeth, said pawl member moveable between a left drive position wherein said left ratchet teeth engage said first ratchet teeth and said right ratchet teeth are disengaged from said first ratchet teeth and a right drive position wherein said right ratchet teeth engage said first ratchet teeth and said left ratchet teeth are disengaged from said first ratchet teeth, the engagement of said left and right ratchet teeth respectively with said first ratchet teeth being on opposite sides of an imaginary ratchet plane containing said rotational axis and being perpendicular to said slide plane;

constraining means for constraining the movement of said pawl member such that said first and second portions slideably engage said first and second flat surfaces for movement therealong;

pawl control means for moving said pawl member between said left and right drive positions and for biasing said left and right ratchet teeth respectively into engagement with said first ratchet teeth to define selected positive drive direction whereby said drive member becomes locked for common rotation with said ratchet head when said ratchet head is rotated in the positive drive direction yet which permits relative rotation of said ratchet head with respect to said drive member when said ratchet head is rotated in a direction opposite the positive drive direction; and a switch member operative to switch said pawl control means between said left and right drive positions, said interior sidewall pawl members and constraining means arranged such that there is an imaginary axis plane parallel to said slide plane and including said rotational axis and imaginary left and right planes which are perpendicular to one another and which bisect left and right regions, respectively, between said ratchet plane and said axis plane, said slide plane being spaced from said axis plane and wherein said left ratchet teeth will engage said first ratchet teeth in said left region, there being a greater number of engaged left teeth on a side of said left plane closer to said ratchet plane, and wherein said right ratchet teeth will engage said first ratchet teeth in said right region, there being a greater number of engaged right teeth on a side of said right plane closer to said ratchet plane.

13. A ratchet drive tool adapted to rotatably drive a work piece, comprising:

a ratchet head having a cylindrical aperture formed therethrough and centered on a rotational axis, said aperture having an interior sidewall which has a first radius of curvature and which is provided with first ratchet teeth therearound;

a drive member mounted within said aperture and rotatable about said rotational axis, said drive member including a disc-shaped base having a surrounding circular edge dimensioned for close-fitted mounting at one end of said aperture, a drive shaft extending axially from a firsr side of said base exteriorly of said aperture and adapted to engage a work piece whereby rotation of said base rotatably drives said drive shaft, and a pawl support structure on a second side of said base opposite said drive shft, said pawl support structure including a C-shaped block rigidly secured to said base and centered on said rotational axis, said block extending into said aperture and having first and second flat end surfaces defining a slide surface oriented in a slide plane parallel to and spaced from said rotational axis, said block having a semi-cylindrical opening centered on said rotational axis and having an entryway between said flat end surfaces;

a pawl member supported by side pawl support structure moveable with respect thereto, said pawl member having first and second flat surface portions and an outer arcuate surface which has a second radius of curvature less than said first radius of curvature, said arcuate surface provided with second ratchet teeth defining left ratchet teeth and right ratchet teeth, said pawl member moveable between a left drive position wherein said left ratchet teeth engage said first ratchet teeth and said right ratchet teeth are disengaged form said first ratchet teeth and a right drive position wherein said right ratchet teeth engage said first ratchet teeth and said left ratchet teeth are disengaged from said first ratchet teeth, the engagement of said left and right ratchet teeth respectively with said first ratchet teeth being on opposite sides of an imaginary ratchet plane containing said rotational axis and being perpendicular to said slide plane;

constraining means for constraining the movement of said pawl member such that said first and second portions sideably engage said first and second flat surfaces for movement therealong said constraining means including a post element forming a portion of said pawl support structure, said post element positioned longitudinally in spaced parallel relation to said slide surface, and a channel longitudinally formed in the arcuate surface of said pawl member, said channel having spaced sides and a bottom, said post element received in said channel and bearing against said bottom to hold said flat surface portions against said flat end surfaces, said side spaced a sufficient distance apart and said post element dimensioned whereby said pawl member may be slideably moved between said left and right drive positions;

pawl control means for moving said pawl members between said left and right drive positions and for biasing said left and right ratchet teeth respectively into engagement with said first ratchet teeth to define a selected positive drive direction whereby said drive member becomes locked for common rotation with said ratchet head when said ratchet head is rotated in the positive drive direction yet which permits relative rotation of said ratchet head with respect to said drive member when said ratchet head is rotated in a direction opposite the positive drive direction; and a switch member operative to switch said pawl biasing means between said left and right drive positions.

14. A ratchet tool according to claim 13 wherein said switch member includes an axial shank aligned with said rotational axis and received within said semi-circular cavity, said axial shank having a radial bore formed therein, said pawl biasing means including a spring positioned in said radial bore and a radially extending pin received in said bore and outwardly biased against said pawl member.

15. A ratchet tool according to claim 14 wherein said pawl member has a concavity separating a side surface thereof opposite said arcuate surface into said first and second flat surface portions and dimensioned to accommodate the radius of said axial shank so that a portion of said shank is located within said concavity, said pin extending within the concavity to contact said pawl member and whereby said shank is rotatable to cause said pin to move said pawl member between said left and right drive positions.

16. A ratchet tool according to claim 15 wherein longitudinal side edge portions of said concavity are defined by quarter cylinder surfaces.

17. A ratchet tool according to claim 15 wherein the side edges of said flat end surfaces adjacent said entryway each has a detent cavity in the plane of said pin whereby the free end of said pin is received within a respective detent cavity in the left and right drive positions.

18. A ratchet tool according to claim 12 including an elongated handle means rigidly connected to said tool head for rotating said tool head about the rotational axis with mechanical advantage.

19. A ratchet drive tool adapted to rotatably drive a work piece, comprising:

a ratchet head having a cylindrical aperture formed therethrough and centered on a rotational axis, said aperture having an interior sidewall which has a first radius of curvature and which is provided with first ratchet teeth therearound;

a drive member mounted within said aperture and rotatable about said rotational axis, said drive member including a disc-shaped base having a surrounding circular edge dimensioned for close-fitted mounting at one end of said aperture, a drive shaft extending axially from a first side of said base portion exteriorly of said aperture in order to engage said work piece, and pawl support structure on a second side of said base portion opposite said drive shaft, said pawl support structure including a pair of upstanding blocks rigidly secured to said base portion on opposite sides of said rotational axis, said blocks having facing edge surfaces forming a semi-cylindrical opening centered on said rotational axis and each block having first and second flat side surfaces such that said first side surfaces define a first planar slide surface on one side of said rotational axis and said second side surfaces define a second planar slide surface on the other side of said rotational axis parallel to said first planar slide surface;

first and second pawl members supported by said pawl support structure moveable with respect thereto, said first and second pawl members having flat surface portions slideably engaging a respective slide surface and constrained for movement therealong and each have an outer arcuate surface opposite said flat surface portions which arcuate surfaces each having a second radius of curvature less than said first radius of curvature, each said arcuate surface provided with second ratchet teeth defining left ratchet teeth and right ratchet teeth, each of said first and second pawl members moveable between a left drive position wherein each of said left ratchet teeth engage said first ratchet teeth and each of said right ratchet teeth are disengaged from said first ratchet teeth and a right drive position wherein each of said right ratchet teeth engage said first ratchet teeth and each of said left ratchet teeth are disengaged from said first ratchet teeth, the engagement of said left and right ratchet teeth respectively with said first ratchet teeth being o opposite sides of an imaginary ratchet plane containing said rotational axis and being perpendicular to said first and second slide surfaces;

constraining means for constraining the movement of each of said first and second pawl members such that said first and second portions slideably engage said first and second pawl members such that said first and second portions slideably engage said first and second slide surfaces for movement therealong;

pawl control means for moving each of said first and second pawl members between said left and right drive positions and for directly and radially biasing said left and right ratchet teeth respectively into engagement with said first ratchet teeth to define a selected positive drive direction whereby said drive member becomes locked for common rotation with said ratchet head when said ratchet head is rotated in the positive drive direction yet which permits relative rotation of said ratchet head with respect to said drive member when said ratchet head is rotated in a direction opposite the positive drive direction;

a switch member operative to switch said pawl control means between said left and right drive positions; and said interior side wall, first and second panel members and first and second planer slide surfaces arranged such that there is an imaginary axis plane lying being between said first and second slide surfaces and parallel of each to said first and second slide surfaces and including said rotational axis and imaginary left and right planes which are perpendicular to one another and which bisect left and right regions, respectively, between said ratchet plane and said axis plane, said slide plane being spaced from said axis lane and wherein said left ratchet teeth will engage said first ratchet teeth in said left region, there being a greater number of engaged left teeth on a side of said left plane closer to said ratchet plane, and wherein said right ratchet teeth will engage said first ratchet teeth in said right region, there being a greater number of engaged right teeth on a side of said right plane closer to said ratchet plane.

20. A ratchet tool according to claim 19 wherein said constraining means includes first and second post elements forming a portion of said pawl support structure, each said post element positioned longitudinally in spaced parallel relation to a respective one of said first and second slide surfaces, and a channel longitudinally formed in the arcuate surface of said each of said first and second pawl members, each said channel having spaced sides and a bottom, a respective one of said post elements received in said channel and bearing against said bottom to hold said flat surface portions of a respective pawl member against its respective said first side surfaces, said sides spaced a sufficient distance apart and said post elements dimensioned whereby each pawl member may be slideably moved between said left and right drive positions.

21. A ratchet tool according to claim 20 wherein said switch member includes an axial shank aligned with said rotational axis and received within said semicircular cavity, said axial shank having a radial bore formed therethrough, said pawl biasing means including a spring positioned in said radial bore and a pair of radially and oppositely extending pins received in said bore and outwardly biased against a respective said pawl member.

22. A ratchet tool according to claim 21 wherein each said pawl member has a concavity separating a side surface thereof opposite its said arcuate surface into said first and second flat surface portions and dimensioned to accommodate the radius of said axial shank so that a portion of said shank is located within each said concavity, said pins extending within the concavities to contact a respective said pawl member and whereby said shank is rotatable to cause said pins to move said pawl members between said left and right drive positions.

23. A ratchet tool according to claim 22 wherein longitudinal side edge portions of said concavities are defined by quarter cylinder surfaces.

24. A ratchet tool according to claim 22 wherein the side edges of said facing surfaces adjacent each has a detent cavity in the plane of said pins whereby the free end of each said pin is received within a respective detent cavity in the left and right drive positions.

25. A ratchet tool according to claim 19 including an elongated handle means rigidly connected to said tool head for rotating said tool head about the rotational axis with mechanical advantage.

* * * * *